US006079070A

United States Patent [19]

Flick

[11] Patent Number: 6,079,070

[45] Date of Patent: Jun. 27, 2000

[54] DISPOSABLE INFLATABLE INCLINABLE CUSHION

[75] Inventor: Roland E. Flick, Elma, N.Y.

[73] Assignee: Gaymar Industries, Inc., Orchard Park, N.Y.

[21] Appl. No.: 09/085,770

[22] Filed: May 28, 1998

[51] Int. Cl.[7] ..... A61G 7/057; A47C 27/10

[52] U.S. Cl. ..... 5/715; 5/713

[58] Field of Search ..... 5/713, 710, 715, 5/615

[56] References Cited

U.S. PATENT DOCUMENTS 5,794,289 8/1998 Wortman et al. ..... 5/713

*Primary Examiner*—Alexander Grosz

*Attorney, Agent, or Firm*—Hodgson Russ Andrews Woods & Goodyear LLP

[57] ABSTRACT

A cushion for use as an overlay for providing pressure relief so that pressure ulcers may be eliminated or retarded. The cushion includes a pair of inflatable side-by-side upper cells, a pair of individually inflatable side-by-side lower bladders, a crib, and a manifold all disposed within a cover. The manifold, which has inlet hoses connectable to a pump and outlet hoses connectable to the cells, bladders, and, if inflatable, the crib, is reusable, and the other components may be made inexpensively to be disposable so that the expense of cleaning and sanitizing after patient use may be avoided. For inclining the cushion upper surface to one side, one of the bladders is inflated while the other is uninflated.

7 Claims, 3 Drawing Sheets

FIG. 1
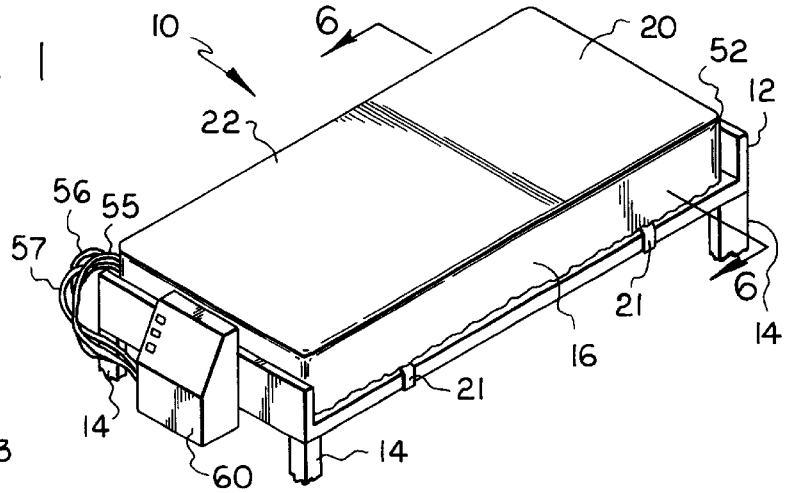
FIG. 2
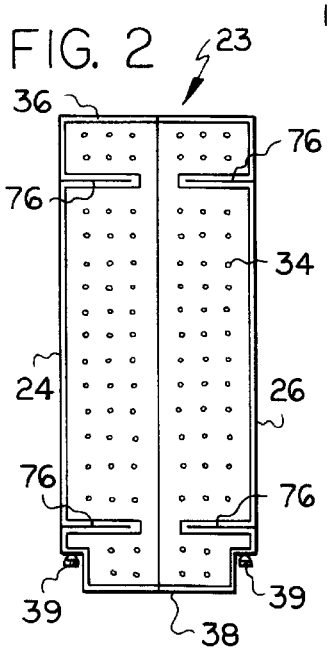
FIG. 3
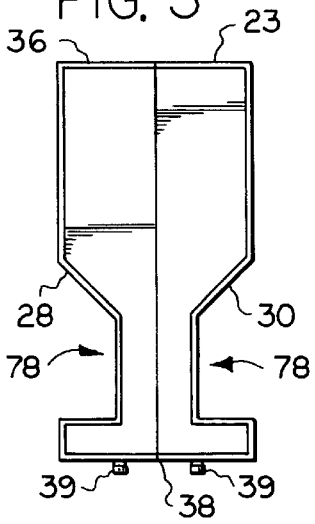
FIG. 4
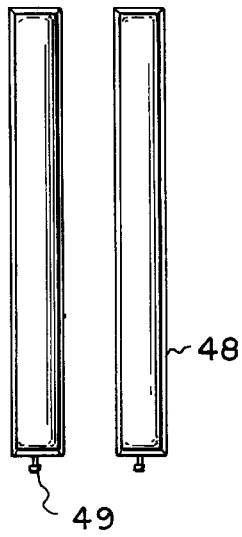
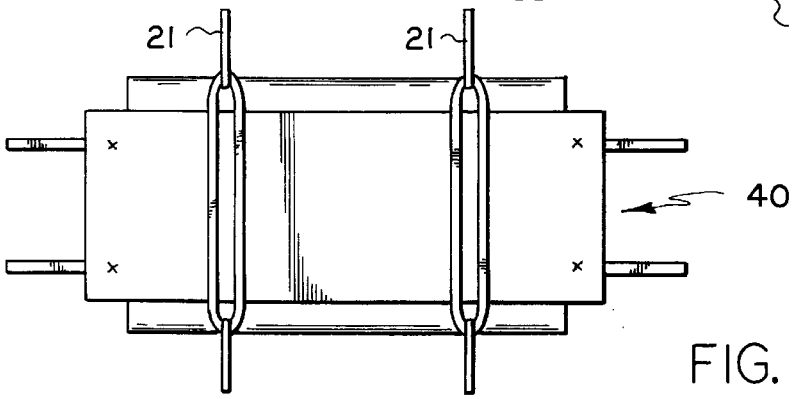
FIG. 8

DISPOSABLE INFLATABLE INCLINABLE CUSHION

The present invention relates generally to inflatable cushions. Air-pressurized cushions are used as overlays. Such overlays provide pressure relief to patients in hospital or home care settings so that the development of pressure ulcers may be prevented or retarded. It is considered desirable to be able to incline the upper surface of such an overlay for the purpose of periodically turning a patient.

BACKGROUND OF THE INVENTION

U.S. Pat. No. 4,454,615, to Whitney, which is assigned to the assignee of the present invention, discloses an overlay comprising an air cell. This overlay does not provide means for inclining the upper surface.

U.S. patent application Ser. No. 08/943,286, filed Oct. 3, 1996 now abandoned, which is assigned to the assignee of the present invention and which is incorporated herein by reference, discloses a mattress having air cell means and foam crib members assembled within a mattress cover. An externally disposed pump routes air through air lines directly to air cell means. The air cell means includes individually inflatable side-by-side air cells and individually inflatable side-by-side bladders underneath the air cells respectively. The air cells and bladders are heat welded together to allow the upper surface of the mattress to be inclined to one side. This mattress satisfies its intended purpose but it is expensive. It is therefore desired to provide an inexpensive, disposable, and replaceable overlay with air cells. The desired overlay allows the upper surface to incline and eliminates the necessity of cleaning and sanitizing after each patient use.

U.S. Pat. Nos. 5,249,319 and 5,325,551 disclose mattresses having air cells or plenums, crib structures, and blowers or air pumps all within a mattress cover. These assemblies also do not allow for disposability of the components as contemplated by the present invention.

It is an object of the present invention to be able to incline the upper surface thereof to one side for patient management.

SUMMARY OF THE INVENTION

The present invention is an inexpensive, disposable, and replaceable inflatable cell means and crib means within a cover. These cell means and crib means are replaceable. A manifold distributes pressurizing gas from a pump to the cell means and to the crib means. The manifold is reusable and is within the cover. In order to incline the upper surface thereof to one side for patient management, the cell means has a pair of individually inflatable side-by-side bladders that underlie the inflatable cell means.

The above and other objects, features, and advantages of the present invention may be found in the following detailed description of the preferred embodiment thereof when read in conjunction with the accompanying drawings wherein the same reference numerals denote the same or similar parts throughout the several views.

BRIEF DESCRIPTION OF THE DRAWINGS

FIG. 1 is a perspective view of a bed containing a cushion which embodies the present invention.

FIG. 2 is a plan view of the upper inflatable cells therefor.

FIG. 3 is a plan view of the lower inflatable cells therefor.

FIG. 4 is a plan view of the bolster bladders therefor.

FIG. 8 is a plan underside view of the crib therefor.

DETAILED DESCRIPTION OF THE PREFERRED EMBODIMENT

Figure 6:
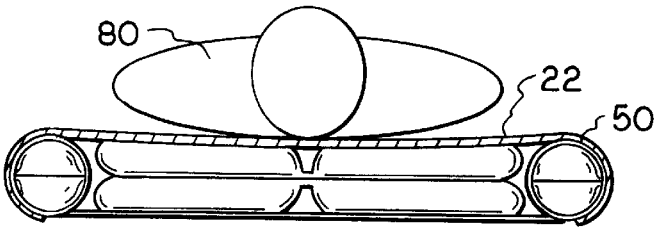
FIG. 6 cushion illustrating the upper surface thereof uninclined.

Referring to the drawings, there is illustrated generally at 10 a bed having a frame 12, a plurality of legs 14, and a support structure such as conventional box springs 16. The box spring 16 receives an overlay cushion, illustrated generally at 20—shown in dotted line, that provides an upper surface 22—shown in dotted line on which a person rests. The cushion 20 may be used, for example, in a hospital or home health care setting. The cushion 20 provides therapeutic pressure relief so that the development of pressure ulcers are prevented or retarded. The box spring 16 and the cushion 20 are held together by any suitable means such as a pair of forward and rear straps 21. These straps 21 attach to a cover 52 which overlies the cushion 20 and covers predetermined portions of the support structure 16, extend under the box springs 16 from opposite sides, and attach by suitable means such as hook and loop fasteners (not shown) sold under the trademark Velcro.

As shown in FIGS. 2 and 3, the cushion 20 has four independent inflatable bladders. The first and second inflatable bladders 24 an 26, as shown in FIG. 2, are the upper side-by-side bladders. The third and fourth inflatable bladders 28 and 30, as shown in FIG. 3, are lower side-by-side bladders.

These bladders are suitable puncture-resistant vinyl film or other suitable air impervious flexible material. These bladders are suitably heat welded together and suitably formed to be strip heat welded together at utilizing principles commonly known to those of ordinary skill in the art to which this invention pertains. The upper cells 24 and 26 each have a plurality of button welds, illustrated at 34, to prevent ballooning thereof. Each of the cells 24, 26, 28, and 30 extends lengthwise, i.e., from the head end 36 to the foot end 38 of the cushion 20. Each cell 24, 26, 28, and 30 has a connector 39, at the foot end 38, for receiving air from inlet hoses (not shown in FIGS. 2 and 3 but shown and described in FIG. 5).

A slit, illustrated at 76, shown in FIG. 2 to be sealed, extends more than half way across each of the upper cells 24 and 26 near the foot and head ends 36, 38. The slit 76 provides stress relief at the exterior ends, in particular the foot end 38.

A notch, illustrated at 78, is formed in each bladder 28 and 30. The notch 78 extends more than half way across the cell and lengthwise over substantially the foot end 38 half of each bladder 28 and 30. Such a bladder design provides relatively greater lifting force to the shoulders, chest, and abdomen areas of a patient that require greater lifting capacity.

Figure 5:
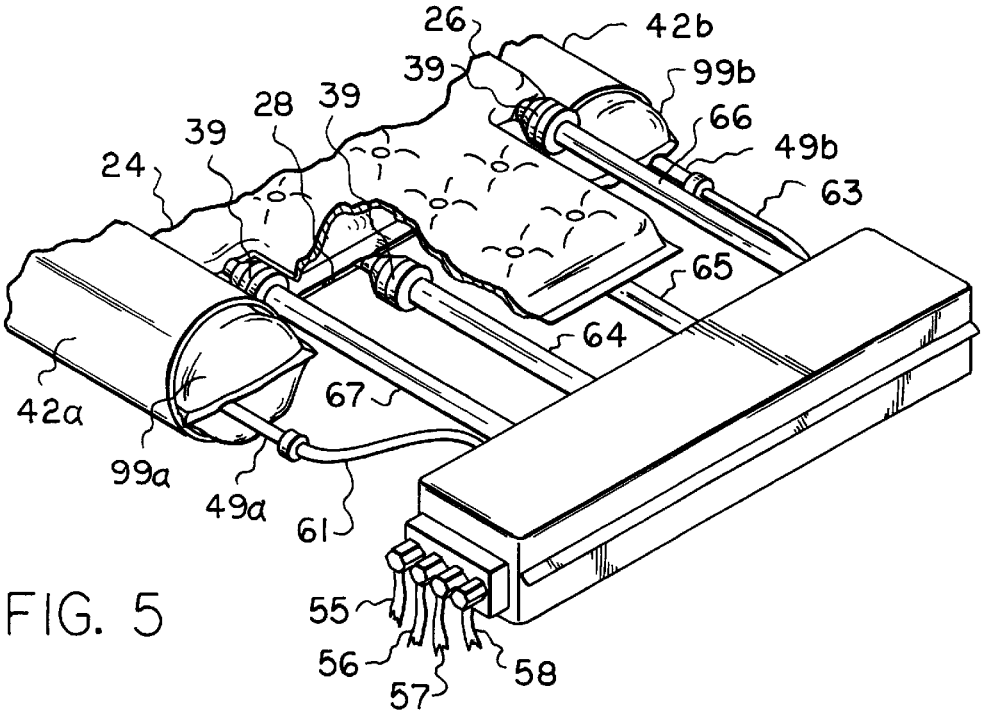
FIG. 5 is a perspective partial view of the cushion with the cover removed to illustrate the arrangement of the air cell means, crib, and manifold, it being understood that the manifold is closely adjacent the ends of the air cells and crib when disposed within the cover.
Figure 7:
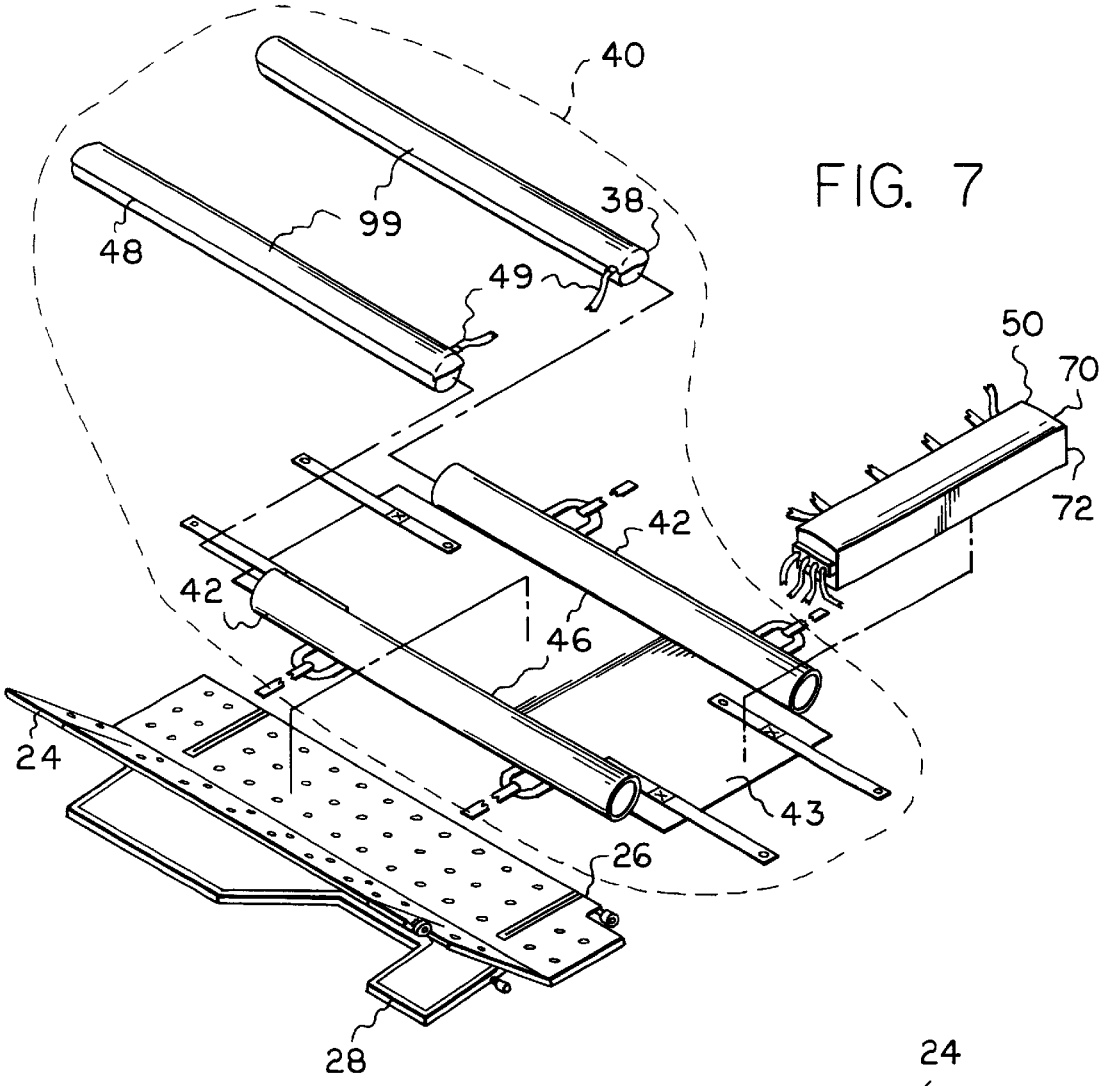
FIG. 7 is an exploded perspective view of the cushion with the cover opened.

The cushion 20 is provided with a crib 40 which provides a framework that receives the air cells 24 and 26 and bladders 28 and 30. The crib 40 has two protruding leg covers 42 and a base 43, as shown in FIG. 7. Each leg cover 42 extends alongside the outer side of the cushion 20 and receives bolster bladders 99. (As shown in FIG. 4) Crib 40 includes weld seams 46 providing restricted movement of each leg cover 42 from the base 43. A connector 49, designated 49*a* and 49*b* at FIG. 5, is positioned at the foot end 38 of the each bolster bladder 99. Alternatively , the crib 40 may be composed of foam material or otherwise suitably composed.

Returning to FIG. 1, a conventional pump 60 supplies air or other suitable pressurizing medium to the cushion 20 and bolster bladders 99. The pump 60 has a pair of hooks (not shown) for suitably hooking onto the frame 12 at the foot end 38 of the bed 10. The air is directed into the cushion 20 through hoses 55, 56, 57, and 58 and a manifold 50 as shown in FIG. 5.

Referring to FIG. 5, the manifold 50 has six outlet hoses, i.e., hoses 61 and 63 for each bolster bladder 99, hoses 66 and 67 for the cells 24 and 26, and hoses 64 and 65 for bladders 28 and 30. A tube or passage within the manifold 50 connects hose 56 with outlet hoses 61, 63, for inflation of the bolster bladders 99*a*, 99*b*. Hose 57 connects via a second tube or passage in the manifold 50 to hoses 65, 66 for inflating/deflating the left bladders 26 and 30. Likewise, hose 58 connects via a tube or passage within the manifold 50 to hoses 64, 67 for inflating/deflating the right bladders 24 and 28.

With the bladders inflated, a person, illustrated at 80, may rest on the cushion 20, as illustrated in FIG. 6, without the upper surface 22 being inclined.

Referring to FIG. 7, the manifold 50 suitably has a soft material, illustrated at 70 and a hard material, illustrated at 72. The soft material 70 is, for example, a sponge rubber overlying the internal tubes of the manifold (not shown). The harder material 72 is for example, a plastic material serving as a floor for receiving the internal tubes. The manifold 50, with soft material 70 on the top surface extends across the foot end 38 of the cushion 20, thus providing a cushion effect on a person's feet.

The cushion 20 and crib 40 are desirably made inexpensively to be disposed after each use by a patient. Such disposability eliminates the expense of cleaning and sanitizing the cushion 20 and crib 40 after each use. The cushion 20 crib 40 and a reusable manifold 50, fit within a cover 52 as shown in FIG. 6. The cover 52 is suitably formed to be zippered closed and unzippered along three sides of the inflatable structure 23 and crib 40. Preferably, the cover 52 is composed of an elastomeric material. The elastomeric material is stretchable and minimizes a "hammocking" effect that interferes with the effectiveness of the inflatable structure. The cover 52 may also be made inexpensively so that it is disposable after use with a patient, thus eliminating the expense of cleaning and sanitizing.

The cover 52 suitably has straps 21, of FIG. 1 internally thereof. The straps 21 may utilize hook and loop fasteners such as those sold under the trademark Velcro. The straps 21 prevent each of the crib legs 42 from shifting.

FIG. 6 shows the bolster bladders 99 and the upper right and left cells 24 and 26 respectively pressurized and the lower bladders 28, 30 pressurized so that the upper surface 22 is level for normal resting of the patient 80 thereon. The upper cells 24 and 26 and bolster bladders 99 should remain pressurized during usage of the cushion 20.

Figure 10:
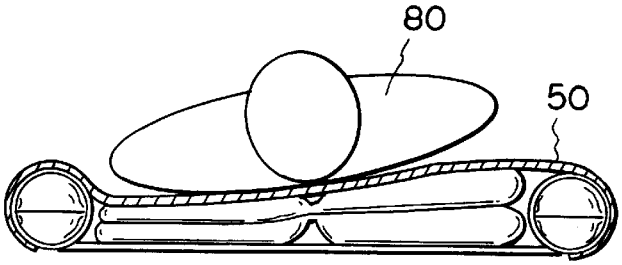
FIGS. 9 and 10 are sectional views of the cushion illustrating the upper surface thereof, inclined to the right, and inclined to the left respectively.
Figure 9:
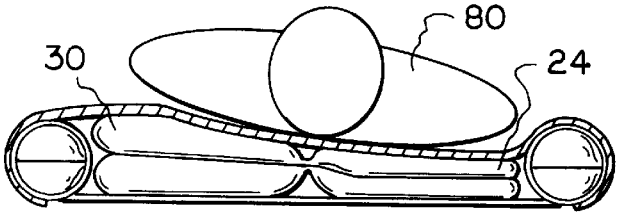

Referring to FIG. 9, for inclining the cushion upper surface 22 to the right for assisting in turning the person 80 over, the right side bladder 28 is deflated by suitably opening a valve (not shown) for flow of air from pump 60 through hose 58, an internal manifold passage, and hose 67, while the left side bladder 30 is inflated. Likewise, referring to FIG. 10, for inclining the cushion upper surface 22 to the left for assisting in turning the person 80 over, the left side bladder 30 is deflated by suitably opening a valve (not shown) for flow of air from pump 60 through hose 57, manifold passage 69, and hose 66, while the right side bladder 28 is inflated.

Figure 11:
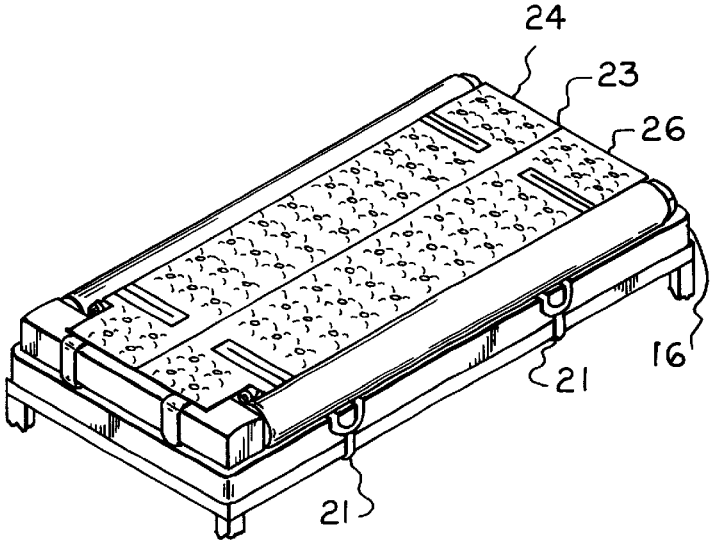
FIG. 11 is a view of FIG. 1 without the cover.

By making the cushion 20, the bolster bladders 99, the crib 40, and the cover 52 inexpensively, they may be disposed of and replaced after use by a patient so as to eliminate the need to clean and sanitize them. Moreover, the bed 10 is easy to assemble as shown in FIGS. 7 and 11.

It should be understood that, while the invention has been described in detail herein, the invention can be embodied otherwise without departing from the principles thereof, and such other embodiments are meant to come within the scope of the present invention as defined by the appended claims.

What is claimed is:

1. A cushion comprising an inflatable disposable cell mattress system having a head-end, a foot-end, and two sides, a crib that extends at least along the sides of the inflatable, disposable cell mattress system, a pump which provides a medium to a manifold which distributes the medium to at least the inflatable disposable cell mattress system, and a cover which encloses the crib, the inflatable disposable cell mattress system, and manifold; and wherein the inflatable disposable cell mattress system has a pair of upper inflatable side-by-side cells and a pair of lower individually inflatable side-by-side bladders, to raise or lower one side of the mattress system, wherein the bladders are shaped to define relatively narrow portions near the foot-end and relatively wide portions near the head-end.

2. The cushion of claim 1 wherein the manifold includes a housing comprised of a fabric material.

3. The cushion of claim 1 wherein the crib is inflatable.

4. The cushion of claim 1 wherein the crib extends along the sides and head-end, and the manifold is positioned at the foot-end.

5. A method for managing bed usage comprising the steps of:

(a) placing a cushion on a supporting surface, the cushion having an inflatable disposable cell mattress system having a head-end, a foot-end, and two sides, a crib that extends at least along the sides of the inflatable, disposable cell mattress system, a pump which provides a fluid medium to a manifold which distributes the medium to at least the inflatable disposable cell mattress system; and a cover which encloses the crib, the inflatable disposable cell mattress system, and manifold; wherein the inflatable disposable cell mattress system has a pair of upper inflatable side-by-side cells and a pair of lower individually inflatable side-by-side bladders to raise or lower one side of the mattress system, wherein the bladders are shaped to define relatively narrow portions near the foot-end and relatively wide portions near the head-end; and (b) removing at least the upper inflatable side-by-side cells from the support surface.

6. The method of claim 5 further comprising the step of removing the cover.

7. The method of claim 5 further comprising the step of inflating the crib.

* * * * *